US005373795A

United States Patent [19]

Kato

[11] Patent Number: 5,373,795

[45] Date of Patent: Dec. 20, 1994

[54] SEWING MACHINE HAVING A PRESSER FOOT DRIVEN INDEPENDENTLY OF A NEEDLE BAR

[75] Inventor: Satoshi Kato, Kariya, Japan

[73] Assignee: Brother Kogyo Kabushiki Kaisha, Nagoya, Japan

[21] Appl. No.: 124,013

[22] Filed: Sep. 21, 1993

[30] Foreign Application Priority Data

Oct. 23, 1992 [JP] Japan ..... 4-285813

[51] Int. Cl.[5] ..... D05B 29/00

[52] U.S. Cl. ..... 112/236; 112/241

[58] Field of Search ..... 112/236, 235, 241, 244, 112/246, 247, 248, 57, 96, 60

[56] References Cited

U.S. PATENT DOCUMENTS 2,386,840 10/1945 Colegrove ..... 112/236

3,282,237 11/1966 Niekrawietz ..... 112/236

FOREIGN PATENT DOCUMENTS 61-159983 7/1986 Japan .

63-296783 12/1988 Japan .

*Primary Examiner*—Clifford D. Crowder

*Assistant Examiner*—Paul C. Lewis

*Attorney, Agent, or Firm*—Oliff & Berridge

[57] ABSTRACT

A sewing machine including a sewing needle which conveys a needle thread; a needle bar which supports the sewing needle; a driver which generates a drive force; a first transmission mechanism which transmits the drive force of the driver to the needle bar so as to reciprocate the sewing needle in an axial direction of the needle; a work-sheet presser foot which is movable parallel to the needle bar; a needle thread take-up lever which takes up the needle thread conveyed by the sewing needle; a take-up-lever support member which supports the needle thread take-up lever, the take-up-lever support member being pivotable about a fixed axis line by being driven by the driver, for oscillating the needle thread take-up lever; and a second transmission mechanism which is independent of the needle bar, and transmits the pivotal motion of the take-up-lever support member to the presser foot so that the presser foot reciprocates in relation with the oscillation of the needle thread take-up lever.

11 Claims, 7 Drawing Sheets

SEWING MACHINE HAVING A PRESSER FOOT DRIVEN INDEPENDENTLY OF A NEEDLE BAR

BACKGROUND OF THE INVENTION

1. Field of the Invention

The present invention relates to a sewing machine having a presser foot which reciprocates in relation with the reciprocative motion of a sewing needle.

2. Related Art Statement

There is known a sewing machine, such as an embroidery sewing machine, which includes a work-fabric presser foot which vertically reciprocates in relation with the vertical reciprocative motion of a sewing needle. FIG. 8 shows an example of such sewing machines, in which a needle bar 101 is supported by a first and a second bearing 102*a*, 102*b* of the sewing machine, such that the needle bar 101 is vertically movable. The needle bar 101 includes, at a lower end portion thereof, a needle holder 101*a* to which a sewing needle 103 is secured. The needle bar 101 vertically reciprocates when receiving the drive force (i.e., rotary motion) of an electric motor via a drive shaft and a crank mechanism (not shown).

A fabric presser foot 104 fits on a lower portion of the needle bar 101. The presser foot 104 is formed by bending an elongate plate, and includes a lower-end bent portion serving as a fabric presser toe 104*a*. The presser toe 104*a* has a through hole (not shown) through which the sewing needle 103 passes. The presser foot 104 further includes an upper-end bent portion 104*b*, and a relief spring 105 is disposed between the upper-end bent portion 104*b* and a needle bar connecting stud 101*b* fixed to the needle bar 101. The presser foot 104 is biased downward by the relief spring 105, so that normally an intermediate bent portion 104*c* (more specifically, bearing member therefor) of the presser foot 104 is held in abutment contact with the needle holder 101*a* of the needle bar 101.

When the needle bar 101 starts to move downward from the position shown in FIG. 8, the presser foot 104 moves downward together with the needle bar 101. Subsequently, the upper-end bent portion 104*b* of the presser foot 104 comes to engage an abutment 102*c* of the second bearing 102*b*, so that the downward movement of the presser foot 104 is stopped. Thus, the presser toe 104*a* of the presser foot 104 is held slightly above a work fabric into which an embroidery is formed by the sewing machine. Then, only the needle bar 101 (and the sewing needle 103) continues to move downward to the lower dead position thereof, so that the sewing needle 103 penetrates the work fabric to form a stitch.

When the sewing needle 103 moves upward from the lower dead position thereof, the presser foot 104 continues to be held slightly above the work fabric until the needle holder 101*a* of the needle bar 101 comes to engage the intermediate bent portion 104*c* of the presser foot 104. Consequently the presser toe 104*a* of the presser foot 104 effectively prevents the work fabric from being dragged up by the sewing needle 103 when the sewing needle 103 moves upward after a needle thread carried thereby has been locked with a shuttle thread at the lower dead position of the sewing needle 103. After the needle holder 101*a* has engaged the intermediate bent portion 104*c* of the presser foot 104, the needle bar 101 and the presser foot 104 move upward as a unit.

However, in the above-described conventional presser-foot arrangement, the relief spring 105 is necessarily disposed between the upper-end bent portion 104*b* of the presser foot 104 and the connecting stud 101*b* of the needle bar 101. The provision of the relief spring 105 at that position results in increasing the vertical dimension of the needle bar 101, thereby increasing the vertical dimension of the free-end or head portion of the horizontal arm of the sewing machine where the needle bar 101 is disposed. This eventually leads to increasing the overall size of the sewing machine. Additionally, each time the sewing needle 103 moves downward, the upper-end bent portion 104*b* of the presser foot 104 collides with the abutment 102*c* of the second bearing 102*b*, for stopping the downward movement of the presser foot 104 slightly above the work fabric. Thus, impact noise is generated due to the collision of the two members 104*b* and 102*c*.

A second example of the above-described sewing machines is disclosed in Non-Examined Japanese Patent Application laid open under Publication No. 61(1986)-159983. The disclosed sewing machine includes a presser-foot bar which supports a presser foot and is directly connected to a crank rod connecting between a needle-bar crank and a needle bar (or a sewing needle). However, since the presser-foot bar of the prior sewing machine is directly connected to the needle-bar crank rod, the presser-foot bar substantially follows the vertical displacement of the needle bar or sewing needle. Thus, it is very difficult to make the stroke of the presser-foot bar smaller than that of the needle bar and thereby reduce the rate of change of the vertical displacement of the presser-foot bar. Therefore, it is very difficult to cause the presser foot to move as if it were stopped slightly above a work fabric to hold down the fabric, for a longer duration of time than the duration of time in which the needle bar is controlled to move as if it were stopped around the lower dead position thereof. Additionally, it is difficult to make the phase of the presser-foot bar largely different from that of the needle bar.

A third example of the related sewing machines is disclosed in Non-Examined Japanese Patent Application laid open under Publication No. 63(1988)-296783. The disclosed sewing machine includes a presser foot bar which supports a presser foot, and an exclusive crank mechanism and a very complex link mechanism which cooperate with each other to transmit the drive force of a drive shaft to the presser foot. With this presser-foot arrangement, an increased number of parts are needed for reciprocating the presser foot, therefore the production cost of the sewing machine is increased.

SUMMARY OF THE INVENTION

It is therefore an object of the present invention to provide a sewing machine which has a needle bar with a reduced vertical dimension and thus enjoys a reduced over-all size thereof, and which also enjoys reduced operation noise.

The above object has been achieved by the present invention, which provides a sewing machine comprising (a) a sewing needle which conveys a needle thread, (b) a needle bar which supports the sewing needle, (c) a driver which generates a drive force, (d) a first transmission mechanism which transmits the drive force of the driver to the needle bar so as to reciprocate the sewing needle in an axial direction of the needle, (e) a work-sheet presser foot which is movable parallel to the needle bar, (f) a needle thread take-up lever which takes up the needle thread conveyed by the sewing needle, (g) a take-up-lever support member which supports the needle thread take-up lever, the take-up-lever support member being pivotable about a fixed axis line by being driven by the driver, for oscillating the needle thread take-up lever, and (h) a second transmission mechanism which is independent of the needle bar, and transmits the pivotal motion of the take-up-lever support member to the presser foot so that the presser foot reciprocates in relation with the oscillation of the needle thread take-up lever.

In the sewing machine constructed as described above, the pivotal motion of the take-up-lever support member is transmitted via the second transmission mechanism to the presser foot, so that the presser foot reciprocates in relation with the oscillation of the needle thread take-up lever. Therefore, the present sewing machine does not need a relief spring which has been provided on a needle bar of the conventional sewing machines. Thus, the present sewing machine can be equipped with the needle bar with a reduced vertical dimension and enjoy a reduced over-all size of the machine. For the same reason, the present sewing machine does not require the presser foot to collide with an abutment provided for stopping the presser foot slightly above a work fabric, in contrast to the conventional sewing machines. Thus, the present sewing machine enjoys reduced operation noise because of the freedom from the impact noise of the presser foot. Furthermore, since the pivotal motion of the take-up-lever support member is utilized to reciprocate the presser foot, the second transmission mechanism can be assembled with a minimum number of parts. Additionally, the stroke of the presser foot can easily be made smaller than that of the needle bar, therefore the presser foot can be controlled to move as if it were stopped slightly above a work fabric for an increased duration of time. Furthermore, the phase of the presser foot can easily be made largely different from that of the needle bar. This arrangement is particularly advantageous in keeping down the work fabric even if the fabric is dragged up by the sewing needle which currently moves up.

According to a preferred feature of the present invention, the driver comprises a drive shaft which is rotatable for reciprocating the needle bar and the sewing needle via the first transmission mechanism, and for pivoting the take-up-lever support member and thereby oscillating the needle thread take-up lever. In this case, the sewing machine may further comprise a crank mechanism which converts the rotation of the drive shaft into the pivotal motion of the take-up-lever support member.

According to another feature of the present invention, the second transmission mechanism comprises a presser-foot bar which extends parallel to the needle bar, and a movable member which is movable by being guided by the presser-foot bar, the movable member being connected, at one end thereof, to the take-up-lever support member so that the movable member reciprocates along the presser-foot bar by being driven by the pivotal motion of the take-up-lever support member, the movable member being engageable, at another end thereof, with one end of the presser foot. In this case, the second transmission mechanism may further comprise a spring which biases the one end of the presser foot in a biasing direction to engage the another end of the movable member, the spring normally permitting the movable member and the presser foot to move as a unit, and permitting, when movement of the presser foot in the biasing direction is stopped, the movable member to continue to move in the biasing direction.

According to yet another feature of the present invention, the second transmission mechanism comprises a connect member which is pivotally connected, at one end thereof, to the take-up-lever support member and is pivotally connected, at another end thereof, to the presser foot. In this case, the second transmission mechanism may further comprise a coupling device which connects the one end of the connect member to a changeable coupling position on the take-up-lever support member, so that the presser foot takes a changeable lower dead position corresponding to the changeable coupling position.

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings, in which.

DETAILED DESCRIPTION OF THE PREFERRED EMBODIES

There will be described an embroidery sewing machine 1 embodying the present invention, by reference to FIGS. 1 through 7.

Figure 1:
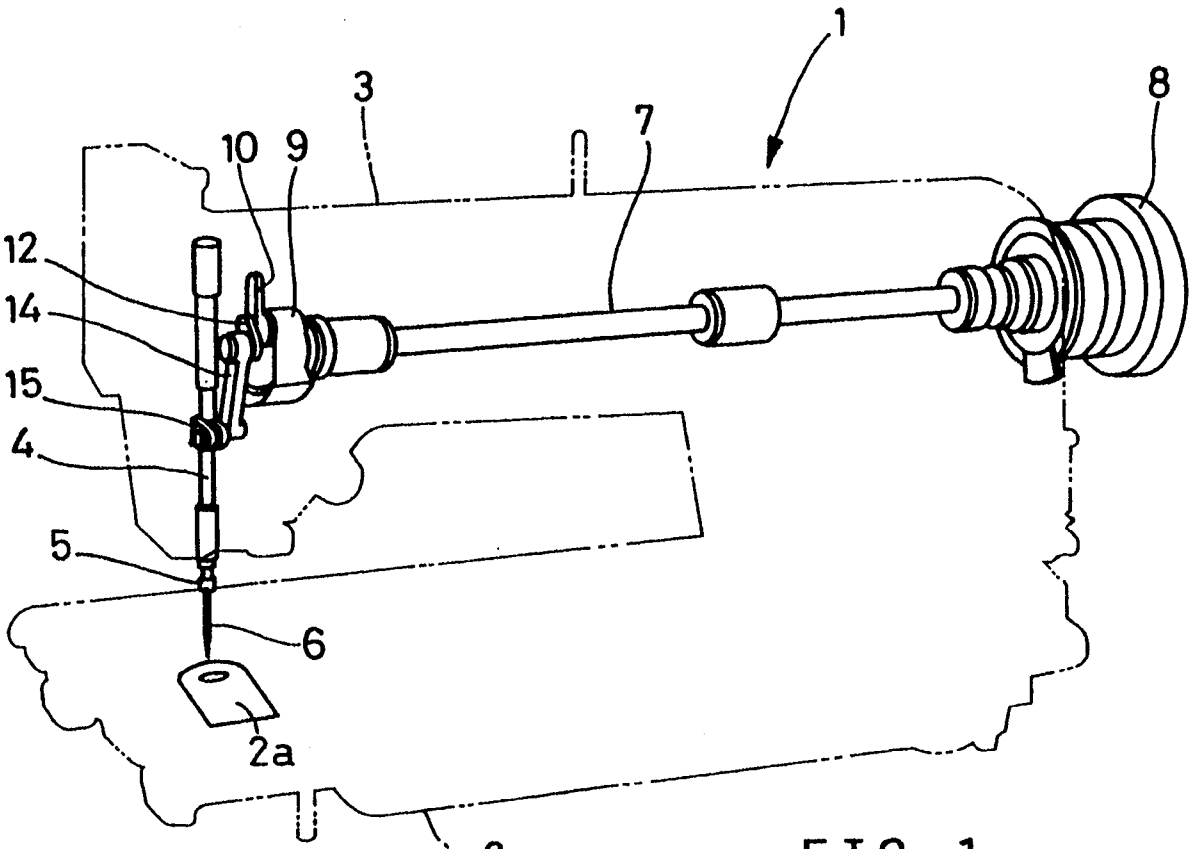
FIG. 1 is a schematic perspective view of an embroidery sewing machine to which the present invention is applied.

Referring first to FIG. 1, there is shown a general arrangement of the present sewing machine 1. The sewing machine 1 includes a bed 2, and an arm 3 which stands at a right-hand end portion of the bed 2 and extends horizontally leftward. A left-hand free portion or head portion of the arm 3 supports a needle bar 4 such that the needle bar 4 is vertically movable. The needle bar 4 includes a needle holder 5 to which a sewing needle 6 is secured. The sewing needle 6 conveys a needle thread (not shown).

Inside the horizontal extension of the arm 3, a drive shaft 7 is disposed such that the drive shaft 7 is rotatable about a center line thereof. A pulley 8 is attached to a right-hand end of the drive shaft 7, and a take-up-lever crank 9 (hereinafter, referred to as the TUL crank 9) is attached to a left-hand end of the drive shaft 7. The drive shaft 7 rotates when the drive shaft 7 receives the drive force (i.e., rotary motion) of an electric motor (not shown) via the pulley 8 and a belt (not shown) wound around the pulley 8.

Figure 2:
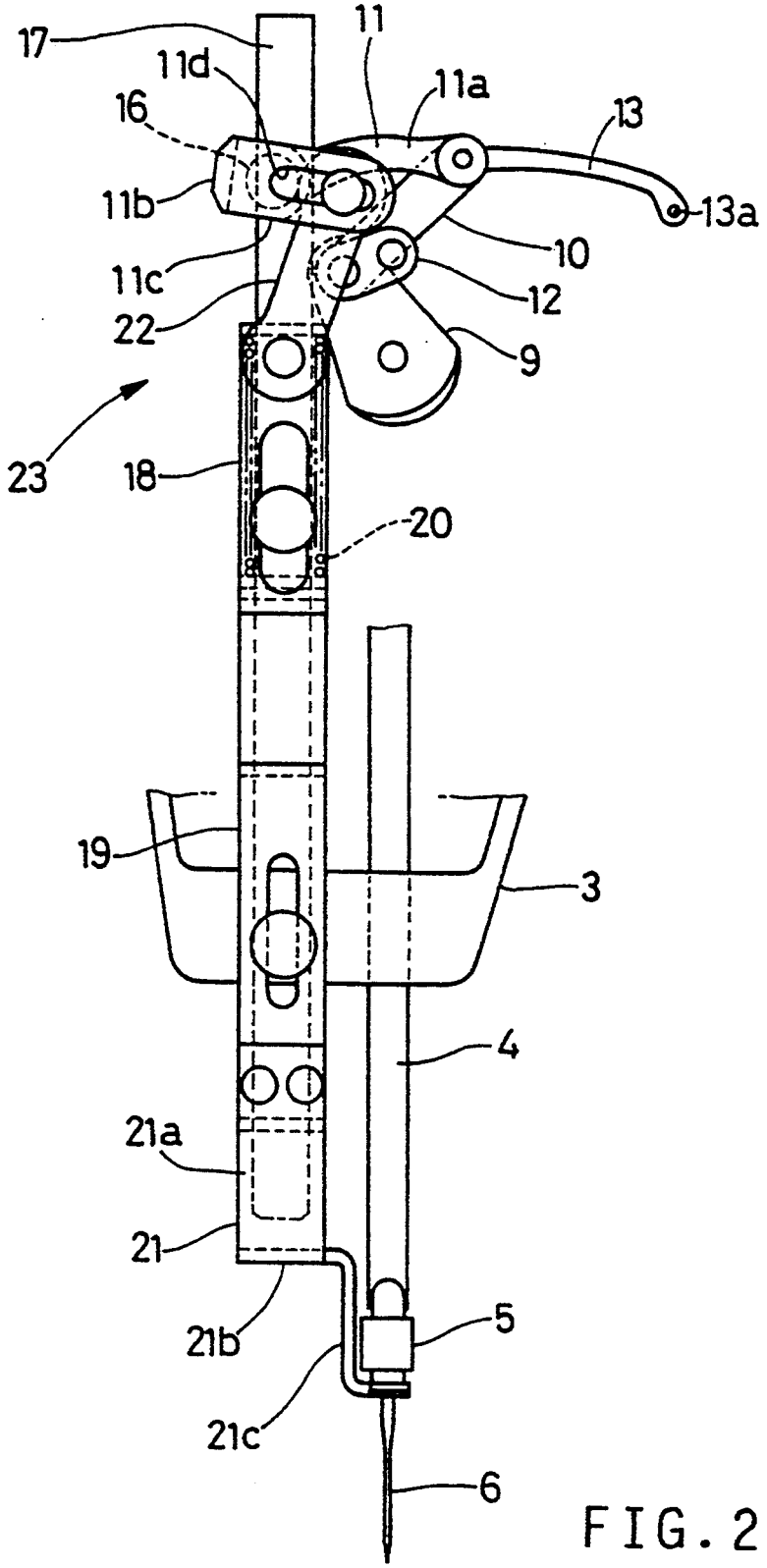
FIG. 2 is a side elevation view of a needle bar, a presser foot, and a transmission mechanism which transmits drive force to the presser foot.

As shown in FIG. 2, a take-up-lever support member 11 (hereinafter, referred to as the TUL support member 11) is connected to the TUL crank 9 via a first connect member 10. The TUL support member 11 is pivotable about an axis member 16 fixed to a framework of the arm 3, and a needle thread take-up lever 13 is fixed to a front end of the TUL support member 11, which will be described in more detail later. Meanwhile, a needle-bar crank 12 is also connected to the TUL crank 9. A needle-bar connecting stud 15, fixed to a middle portion of the needle bar 4, is connected to the needle-bar crank 12 via a second connect member 14. When the drive shaft 7 is driven or rotated, the TUL support member 11 or take-up lever 13 pivots or oscillates about the axis member 16, and concurrently the needle bar 4 or sewing needle 6 vertically reciprocates.

Although not shown, there is disposed, under a throat plate 2*a* of the bed 2 below the needle bar 4, a rotary needle-thread catching device such as a shuttle. Further, although not shown, at a left-hand end portion of the bed 2, there are provided an embroidery frame which supports a work sheet such as a work fabric into which an embroidery is formed by the sewing machine 1, and additionally a frame driving device which moves the embroidery frame in an X direction and a Y direction perpendicular to the X direction above the bed 2.

In FIG. 1, the TUL support member 11, take-up lever 13, presser foot (21, FIG. 2) which is vertically movable in relation with the vertical movement of the sewing needle 6, or some members provided around the presser foot 21 are not shown for simplicity purposes only. The arrangement of each of those members will be described below by reference to FIGS. 2 through 6.

Figure 4:
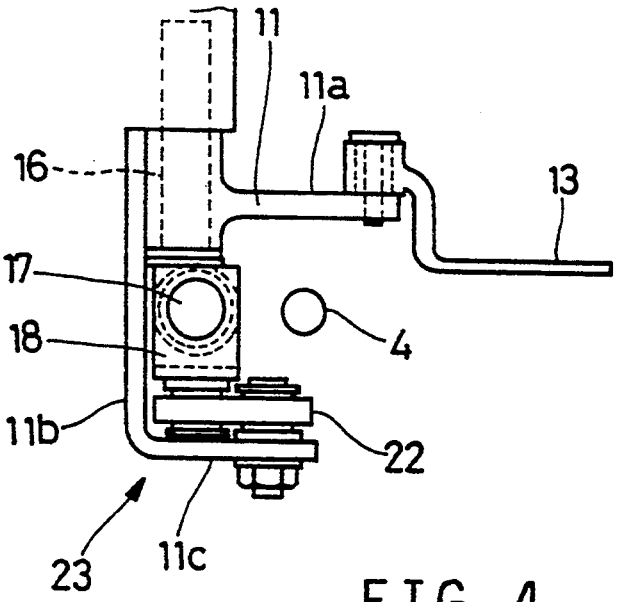
FIG. 4 is a plan view of the transmission mechanism of FIG. 2.
Figure 5:
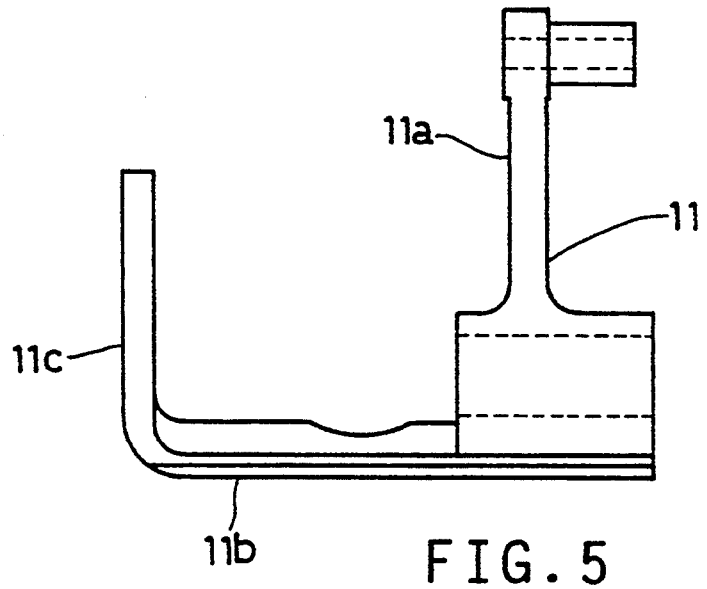
FIG. 5 is a plan view of a take-up-lever support member of the sewing machine of FIG. 1.

First, as shown in FIG. 5, the TUL support member 11 includes an arm portion 11*a* to which the take-up lever 13 is fixed, a first extension portion 11*b* extending from the arm portion 11*a*, and a second extension portion 11*c* extending from the first extension portion 11*b* so as to provide a generally L-shaped configuration. As shown in FIGS. 2 and 4, the TUL support member 11 is supported by the framework of the arm 3 or machine 1, such that the arm portion 11*a* of the TUL support member 11 is pivotable about the axis member 16 fixed to the framework of the arm 3. With this arrangement, the second extension portion 11*c* extends away from the axis member 16.

Figure 6:
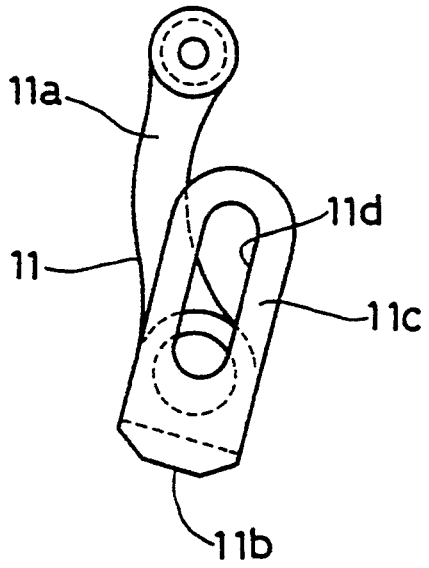
FIG. 6 is a side view of the take-up-lever support member of FIG. 5.

The take-up lever 13 has a thread hole 13*a* through which the needle thread conveyed by the sewing needle 6 passes, and the take-up lever 13 is fixed to the front end of the arm portion 11*a* of the TUL support member 11. As shown in FIG. 2, an upper end of the first connect member 10 is pivotally coupled to the front end of the arm portion 11*a*. With this arrangement, the TUL support member 11 or take-up lever 13 is pivoted or oscillated when the TUL crank 9 is driven by the drive shaft 7. As shown in FIG. 6, the second extension portion 11*c* of the TUL support member 11 has an elongate hole 11*d*.

Figure 3:
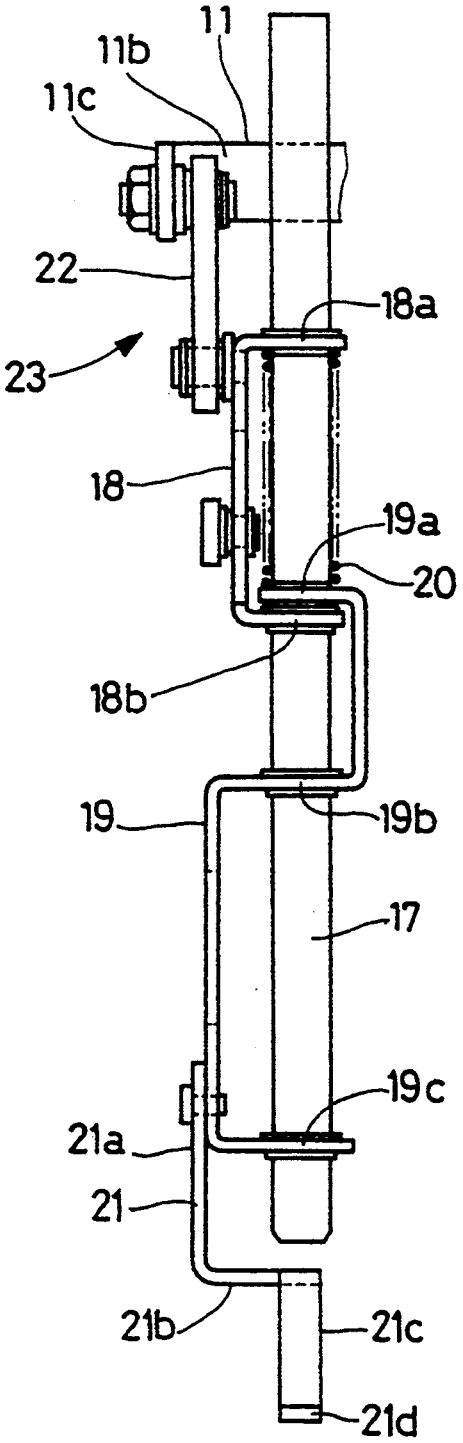
FIG. 3 is a front elevation view of the transmission mechanism of FIG. 2.

Meanwhile, as shown in FIGS. 2 and 4, a presser-foot bar 17 is disposed in rear of the needle bar 4, such that the presser-foot bar 17 vertically extends parallel to the needle bar 4. As shown in FIG. 3, a generally U-shaped movable member 18 fits on the presser-foot bar 17 such that the movable member 18 is movable in the axial direction of the presser-foot bar 17. The movable member 18 includes an upper-end and a lower-end horizontal bent portion 18*a*, 18*b* each of which has a through hole (not shown) through which the presser-foot bar 17 extends.

A generally S-shaped presser-foot support member 19 (hereinafter, referred to as the PF support member 19) fits on the presser-foot bar 17 such that the PF support member 19 is movable in the axial direction of the presser-foot bar 17. The PF support member 19 includes an upper-end, a middle, and a lower-end horizontal bent portion 19*a*, 19*b*, 19*c* each of which has a through hole (not shown) through which the presser-foot bar 17 extends.

The movable member 18 and the PF support member 19 fit on the presser-foot bar 17 such that the lower-end bent portion 18*b* of the movable member 18 is engageable with the upper-end bent portion 19*a* of the PF support member 19, and such that a coil spring 20 is disposed between the upper-end bent portion 18*a* of the movable member 18 and the upper-end bent portion 19*a* of the PF support member 19. The coil spring 20 biases the PF support member 19 downward, so that normally the movable member 18 and the PF support member 19 are engaged with each other and accordingly move as a unit.

A presser foot 21 is fixed to a side surface of a lower-end portion of the PF support member 19 defined between the middle and lower-end bent portions 19*b*, 19*c* thereof. Thus, the presser foot 21 is supported on the presser-foot bar 17 such that the presser foot 21 is vertically movable parallel to the needle bar 4. As shown in FIGS. 2 and 3, the presser foot 21 includes a first vertical portion 21*a* fixed to the PF support member 19, a horizontal portion 21*b* rectangularly bent from the lower end of the first vertical portion 21*a*, a second vertical portion 21*c* laterally rectangularly bent from one of opposite sides of a free end portion of the horizontal portion 21*b*, and a fabric presser toe 21*d* rectangularly bent from the lower end of the second vertical portion 21*c*. The presser toe 21*d* has a through hole (not shown) through which the sewing needle 6 passes.

As shown in FIGS. 2 and 3, a lower end of a third connect member 22 is pivotally coupled to a side surface of an upper-end portion of the movable member 18. An upper end of the third connect member 22 is pivotally coupled to the elongate hole 11*d* of the second extension portion 11*c* of the TUL support member 11. With this arrangement, the movable member 18 vertically reciprocates on the presser-foot bar 17 when the TUL support member 11 pivots about the axis member 16. Together with the movable member 18, the PF support member 19 and the presser foot 21 vertically reciprocate as a unit on the presser-foot bar 17 with the help of the biasing force of the coil spring 20. The TUL support member 11 (specifically, first and second extension portions 11*b*, 11*c*), third connect member 22, movable member 18, and PF support member 19 cooperate with each other to serve as a transmission mechanism 23 which transmits the pivotal motion of the TUL support member 11 to the presser foot 21.

In the present sewing machine 1, it is possible to change the position of coupling between the upper end of the third connect member 22 and the elongate hole 11*d* of the TUL support member 11, for example by loosening and tightening a screw or a nut. A lower dead position of the presser foot 21 is adjustable by changing the above-indicated coupling position of the third connect member 22 with the elongate hole 11*d* of the TUL support member 11. Specifically, when the coupling position is established at a right-hand end of the elongate hole 11*d* as seen in FIG. 2, the lower dead position of the presser foot 21 takes the lowest possible position that is suitable for sewing thin fabrics. On the other hand, when the coupling position is established at a left-hand end of the elongate hole 11*d*, the lower dead position of the presser foot 21 takes the highest possible position that is suitable for sewing thick fabrics.

There will be described the operation of the embroidery sewing machine 1 constructed as described above, by reference to FIG. 7.

Figure 7:
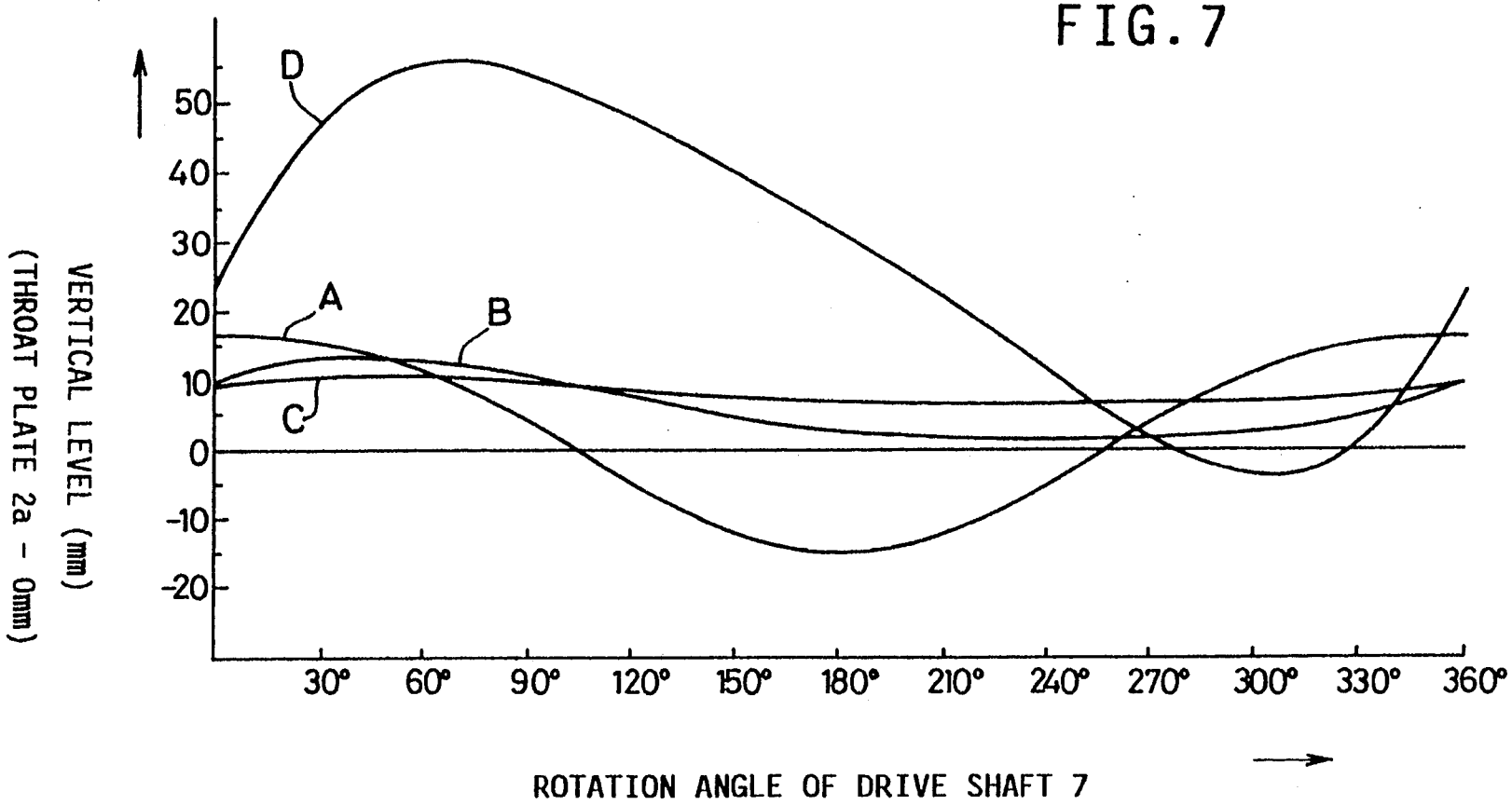
FIG. 7 is a graph showing the relationship between the angle of rotation of a drive shaft of the sewing machine of FIG. 1, and the vertical position of each of a lower end of a sewing needle (A), a lower end of the presser foot (B, C), and a thread hole of a needle thread take-up lever (D)

The graph of FIG. 7 shows the relationship between the angle of rotation of the drive shaft 7 of the sewing machine 1, and the vertical position of each of a lower end of the sewing needle 6 (indicated at "A"), a lower end of the presser foot 21 (indicated at "B" and "C"), and the thread hole 13*a* of the take-up lever 13 (indicated at "D"). The ordinate of the graph indicate vertical levels of the sewing machine 1, i.e., heights (units: mm) as measured from the throat plate 2*a* (=0 mm), and the abscissa of the graph indicate rotation angles of the drive shaft 7 as measured from the position of origin of the drive shaft 7.

In the graph, the curve A represents the variation of the position of the lower end of the sewing needle 6; the curve B represents the variation of the position of the lower end of the presser foot 21 in the case of sewing thin fabrics when the third connect member 22 is coupled to the right-hand end (FIG. 2) of the elongate hole 11*d* of the TUL support member 11; the curve C represents the variation of the position of the lower end of the presser foot 21 in the case of sewing thick fabrics when the third connect member 22 is coupled to the left-hand end (FIG. 2) of the elongate hole 11*d*; and the curve D represents the variation of the position of the thread hole 13*a* of the take-up lever 13. Only the curve D represents values obtained by subtracting 250 mm from actual positions of the take-up lever 13, but the curve D accurately represents amounts of variation of the actual positions.

When the drive shaft 7 rotates, the sewing needle 6 operates in the following manner: Upon application of electric power to the drive motor (not shown) for the sewing machine 1, the drive shaft 7 is driven and rotated, so that the drive force or rotary motion of the drive shaft 7 is transmitted and converted into the vertical reciprocation of the needle bar 4 via the TUL crank 9, needle-bar crank 12, second connect member 14 and needle-bar connecting stud 15. Consequently, the sewing needle 6 vertically reciprocates. During the vertical reciprocation, the position of the lower end of the sewing needle 6 varies with the rotation angle of the drive shaft 7, i.e., with time as indicated by the curve A in the graph of FIG. 7.

More specifically, at the position of origin of the drive shaft 7, the lower end of the sewing needle 6 takes an upper dead position thereof. As the drive shaft 7 rotates from the position of origin, the sewing needle 6 moves downward. At a 180° rotation (i.e., half turn) of the drive shaft 7, the lower end of the sewing needle 6 takes a lower dead position thereof. As the drive shaft 7 further rotates, the sewing needle 6 moves upward. When the drive shaft 7 has been rotated by 360° (i.e., one full turn) and backed to the position of origin, the lower end of the sewing needle 6 returns to the upper dead position thereof.

When the drive shaft 7 is rotated by the drive motor, the presser foot 21 and the needle-thread take-up lever 13 operate as follows: Upon rotation of the drive shaft 7, the rotary motion of the drive shaft 7 is transmitted to the TUL support member 11 via the TUL crank 9 and the first connecting member 10. Consequently, the take-up lever 13 oscillates about the axis member 16. During the oscillation, the position of the thread hole 13*a* of the take-up lever 13 varies with the rotation angle of the shaft 7 as indicated by the curve D in the graph of FIG. 7.

When the TUL support member 11 pivots about the axis member 16, the pivotal motion of the second extension portion 11*c* of the TUL support member 11 is transmitted to the movable member 18 via the third connect member 22. Consequently, the movable member 18 vertically reciprocates. The PF support member 19 vertically reciprocates together with the movable member 18, so that the presser foot 21 vertically reciprocates with the PF support member 19. In the event that the third connect member 22 is coupled, for sewing a thin fabric, to the right-hand end of the elongate hole 11*d* of the TUL support member 11 as shown in FIG. 2, the position of the lower end (i.e., fabric presser toe 21*d*) of the presser foot 21 varies with the rotation angle of the driving shaft 7, i.e., with time as indicated by the curve B in the graph of FIG. 7.

In the above case, the sewing machine 1 is adapted such that, when the toe 21*d* of the presser foot 21 takes a lower dead position thereof, the toe 21 is 1.0 mm above the upper surface of the throat plate 2*a*. This position corresponds to a 238.63° rotation of the drive shaft 7. Thus, the toe 21*d* of the presser foot 21 appears around this position as if it were stopped slightly above the work fabric, while the sewing needle 6 penetrates the work fabric and locks the needle thread conveyed thereby, with a bobbin thread fed from a bobbin rotatably supported by the shuttle (not shown) disposed below the throat plate 2*a* of the machine bed 2.

When the sewing needle 6 is moving upward from the lower dead position thereof, specifically after having passed the upper surface of the throat plate 2*a* (0 mm vertical level), the presser foot 21 appears to continue to remain slightly above the throat plate 2*a*, although the presser foot 21, in fact, is moving upward at a very low rate. Therefore, even if the work fabric is dragged up by the sewing needle 6 which is moving upward, the presser foot 21 effectively prevents the fabric from being lifted off the machine bed 2.

When the sewing operation of the sewing machine 1 is ceased, the fabric presser toe 21*d* of the presser foot 21 is stopped and held about 13 mm above the throat plate 2*a*. This position corresponds to an about 40° rotation of the drive shaft 7. This arrangement is advantageous in that, when the operator sets or removes the embroidery frame (not shown) on or from the sewing machine 1, the presser foot 21 does not interfere with the operator's work.

Meanwhile, in the event that the third connect member 22 is coupled, for sewing a thick fabric, to the right-hand end of the elongate hole 11*d* of the TUL support member 11, the position of the lower end or toe 21*d* of the presser foot 21 varies with the rotation angle of the drive shaft 7 as indicated by the curve C in the graph of FIG. 7. In this case, the sewing machine 1 is adapted such that, when the toe 21*d* of the presser foot 21 takes the lower dead position thereof, the toe 21 is 6.0 mm above the upper surface of the throat plate 2*a*.

In either one of the above-described two cases (indicated by the curves B and C in FIG. 7), if the downward movement of the presser foot 21 is obstructed because the toe 21*d* abuts against an obstacle (e.g., embroidery frame), the coil spring 20 is compressed and deformed, so that only the movable member 18 continues to move downward and the PF support member 19 and the presser foot 21 are stopped at the position where the toe 21 abuts on the obstacle. This arrangement results in preventing the presser-foot driving and transmission mechanism from failing to operate.

Figure 8:
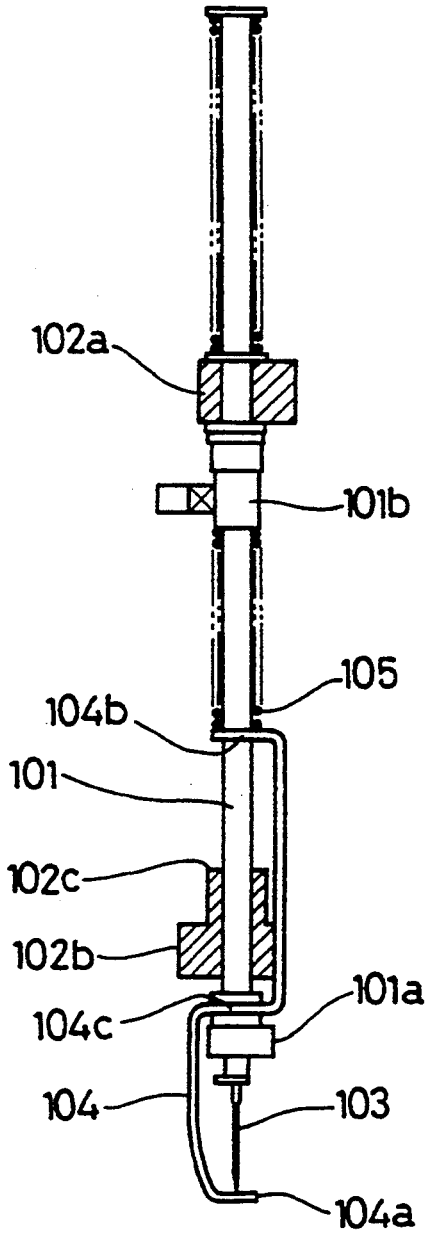
FIG. 8 PRIOR ART
FIG. 8 is a front view of a conventional arrangement including a needle bar and a presser foot.

As is apparent from the foregoing description, the transmission mechanism 23 transmits the pivotal motion of the TUL support member 11 to the presser foot 21, so that the presser foot 21 vertically reciprocates in relation with the oscillation of the needle thread take-up lever 13. This is in contrast to the conventional arrangement of FIG. 8 wherein the relief spring 105 disposed on the needle bar 101 actuates the presser foot 104. Since the needle bar 4 of the present sewing machine 1 does not need such a relief spring, the vertical dimension of the needle bar 4 can be shortened as such. This leads to reducing the overall size of the sewing machine 1.

Additionally, the presser foot 21 is actuated through the transmission mechanism 23 independent of the needle bar 4, though the presser foot 21 is driven in relation with the reciprocation of the needle bar 4 or sewing needle 6 as indicated in FIG. 7. This arrangement has eliminated the need with the conventional arrangement of FIG. 8 to dispose the abutment 102*c* for stopping the presser foot 104 slightly above the work fabric by utilizing the collision of the presser foot 104 with the abutment 102*c*. Thus, the present arrangement contributes to preventing the generation of impact noise due to the collision of the presser foot 104 and the abutment 102*c*, thereby reducing the overall operation noise of the sewing machine 1.

While the illustrated sewing machine 1 is of the type wherein the drive motor therefor is provided outside the framework of the sewing machine 1, it goes without saying that the principle of the present invention is applicable to a sewing machine of the type wherein a drive source is incorporated therein.

In addition, the present invention is applicable to other sewing machines than an embroidery sewing machine described in the illustrated embodiment.

While the present invention has been described in its preferred embodiments, it is to be understood that the present invention may be embodied with other changes, improvements and modifications that may occur to those skilled in the art without departing from the scope and spirit of the invention as defined in the appended claims.

What is claimed is:

1. A sewing machine comprising:

a sewing needle which conveys a needle thread;

a needle bar which supports said sewing needle;

a driver which generates a drive force;

a first transmission mechanism which transmits said drive force of said driver to said needle bar so as to reciprocate said sewing needle in an axial direction of the needle;

a work-sheet presser foot which is movable parallel to said needle bar;

a needle thread take-up lever which takes up the needle thread conveyed by said sewing needle;

a take-up-lever support member which supports said needle thread take-up lever, said take-up-lever support member being pivotable about a fixed axis line by being driven by said driver, for oscillating said needle thread take-up lever; and a second transmission mechanism which is independent of said needle bar, and transmits the pivotal motion of said take-up-lever support member to said presser foot so that the presser foot reciprocates in relation with the oscillation of said needle thread take-up lever.

2. A sewing machine according to claim 1, wherein said driver comprises a drive shaft which is rotatable for reciprocating said needle bar and said sewing needle via said first transmission mechanism, and for pivoting said take-up-lever support member and thereby oscillating said needle thread take-up lever.

3. A sewing machine according to claim 2, further comprising a crank mechanism which converts the rotation of said drive shaft into the pivotal motion of said take-up-lever support member.

4. A sewing machine according to claim 1, wherein said second transmission mechanism comprises:

a presser-foot bar which extends parallel to said needle bar; and a movable member which is movable by being guided by said presser-foot bar, said movable member being connected, at one end thereof, to said take-up-lever support member so that the movable member reciprocates along the presser-foot bar by being driven by the pivotal motion of said take-up-lever support member, said movable member being engageable, at another end thereof, with one end of said presser foot.

5. A sewing machine according to claim 4, wherein said second transmission mechanism further comprises a spring which biases said one end of said presser foot in a biasing direction to engage said another end of said movable member, said spring normally permitting the movable member and the presser foot to move as a unit, and permitting, when movement of the presser foot in said biasing direction is stopped, the movable member to continue to move in said biasing direction.

6. A sewing machine according to claim 5, wherein said movable member includes an upper and a lower horizontal extension each fitted on said presser-foot bar, and a vertical connect portion connecting between said upper and lower horizontal extensions, said one end of said presser foot being engageable with said lower extension of the movable member, said spring being provided between said upper extension of the movable member and said one end of the presser foot.

7. A sewing machine according to claim 6, wherein said second transmission mechanism further comprises a presser-foot support member including an upper, an intermediate and a lower horizontal portion each fitted on said presser-foot bar, and further including a first vertical connect portion connecting between said upper and intermediate horizontal portions, and a second vertical connect portion connecting between said intermediate and lower horizontal portions, said second vertical connect portion being opposite to said first vertical connect portion with respect to said presser-foot bar, said upper horizontal portion of said presser-foot support member being engageable with said lower horizontal extension of said movable member such that said vertical connect portion of the movable member is opposite to said first vertical connect portion of the presser-foot support member with respect to said presser-foot bar and is in alignment with said second vertical connect portion of the presser-foot support member, said presser foot being fixed to said second vertical connect portion of the presser-foot support member.

8. A sewing machine according to claim 1, wherein said second transmission mechanism comprises a connect member which is pivotally connected, at one end thereof, to said take-up-lever support member and is pivotally connected, at another end thereof, to said presser foot.

9. A sewing machine according to claim 8, wherein said second transmission mechanism further comprises a coupling device which connects said one end of said connect member to a changeable coupling position on said take-up-lever support member, so that said presser foot takes a changeable lower dead position corresponding to said changeable coupling position.

10. A sewing machine according to claim 9, wherein said coupling device comprises an extension portion extending from said take-up-lever support member in a direction away from said fixed axis line of the take-up-lever support member, said extension portion having an elongate hole defining said changeable coupling position on the take-up-lever support member.

11. A sewing machine according to claim 8, wherein said second transmission mechanism further comprises:

a presser-foot bar which extends parallel to said needle bar; and a movable member which is movable by being guided by said presser-foot bar, said movable member being pivotally connected, at one end thereof, to said another end of said connect member, so that the movable member reciprocates along the presser-foot bar by being driven by the pivotal motion of said take-up-lever support member via the connect member, said movable member engaging, at another end thereof, with said presser foot.

* * * * *